73-654 SR
7/13/82 XR 4,339,640

United States Patent [19]
Grant

[11] 4,339,640
[45] Jul. 13, 1982

[54] ELECTRICAL SWITCH

[75] Inventor: John T. Grant, Guestwick, England

[73] Assignee: Pittway Corporation, Syosset, N.Y.

[21] Appl. No.: 177,566

[22] Filed: Aug. 13, 1980

[51] Int. Cl.[3] ..... H01H 35/02
[52] U.S. Cl. ..... 200/61.45 R; 73/654; 200/61.52; 200/61.48; 200/277
[58] Field of Search ..... 73/652, 654, 649; 200/61.45 R, 61.52, 61.53, 61.48, 277; 340/566, 644, 669, 686, 689, 691

[56] References Cited

U.S. PATENT DOCUMENTS

| | | | |
|---|---|---|---|
| 3,108,252 | 10/1963 | Torres | 340/669 |
| 3,384,850 | 5/1968 | Cameron et al. | 338/558 |
| 3,509,298 | 4/1970 | Kirk | 200/61.45 R |
| 3,520,200 | 7/1970 | Rogers | 200/61.45 R |
| 3,539,740 | 11/1970 | Isenor et al. | 200/61.45 R |
| 3,553,399 | 1/1971 | Osen et al. | 200/61.45 R |
| 3,559,203 | 1/1971 | Hall et al. | 340/566 |
| 3,560,680 | 2/1971 | Clarke | 200/61.45 R |
| 3,594,520 | 7/1971 | Hall et al. | 200/84 R |
| 3,671,690 | 6/1972 | Parlato | 123/204 |
| 3,735,072 | 5/1973 | Six | 200/61.45 R |
| 3,812,726 | 5/1974 | Bell | 73/503 |
| 3,962,696 | 6/1976 | Smith et al. | 340/566 |
| 4,025,744 | 5/1977 | Kniskern | 200/61.45 R |
| 4,042,796 | 8/1977 | Zink | 200/61.45 R |
| 4,085,304 | 4/1978 | Hasler | 200/61.45 R |
| 4,185,180 | 1/1980 | Anderson | 200/61.45 R |
| 4,191,869 | 3/1980 | Tanaka et al. | 200/61.45 R |

FOREIGN PATENT DOCUMENTS

| | | | |
|---|---|---|---|
| 1296679 | 6/1969 | Fed. Rep. of Germany | 200/61.45 R |
| 776878 | 2/1935 | France | 200/61.45 R |
| 1533242 | 7/1968 | France | 200/61.45 R |

*Primary Examiner*—Kyle L. Howell
*Assistant Examiner*—David V. Carlson

[57] ABSTRACT

A vibration sensor has a base with two support structures on the base. Each support structure includes a pair of spaced juxtaposed electrical contact members that define a support region, and a crossbar element that has two spaced apart electrically conductive portions is supported on the contact members in the corresponding support regions for completing electric circuits between the corresponding pairs of contact members and for movement away from the contact members under the influence of acceleration forces to which the base is subjected to interrupt those electric circuits. Terminal means connect each contact member to remote circuitry.

13 Claims, 7 Drawing Figures

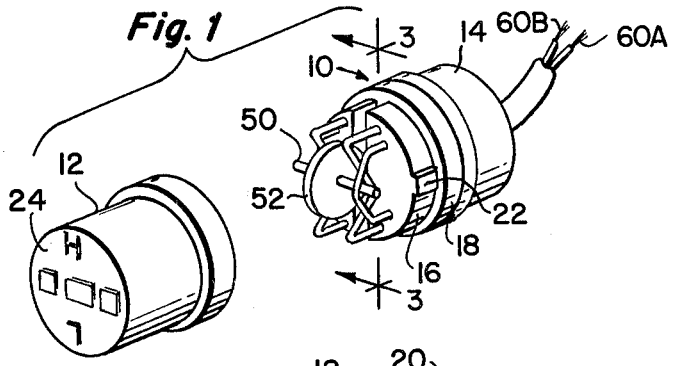
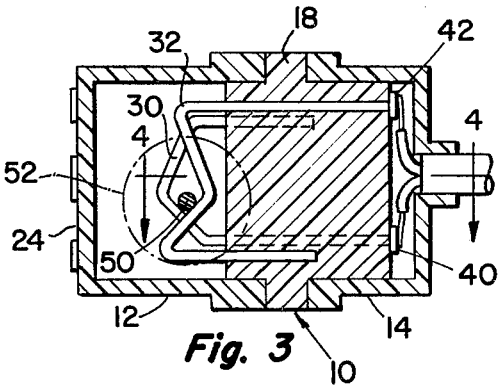
Fig. 3
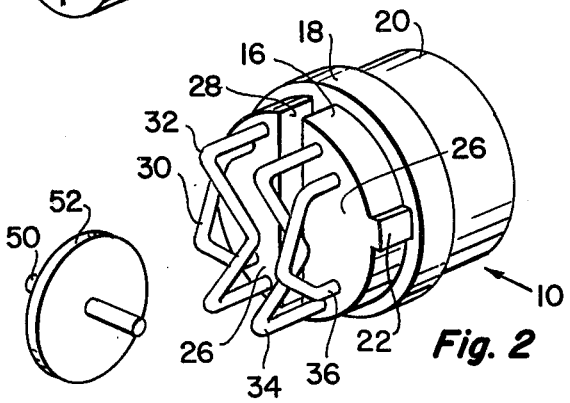
Fig. 2
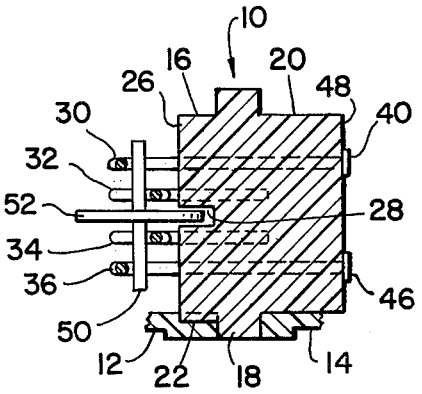
Fig. 4
Fig. 5
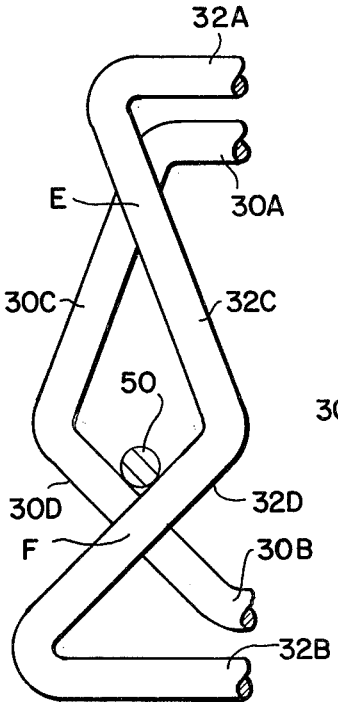
Fig. 6
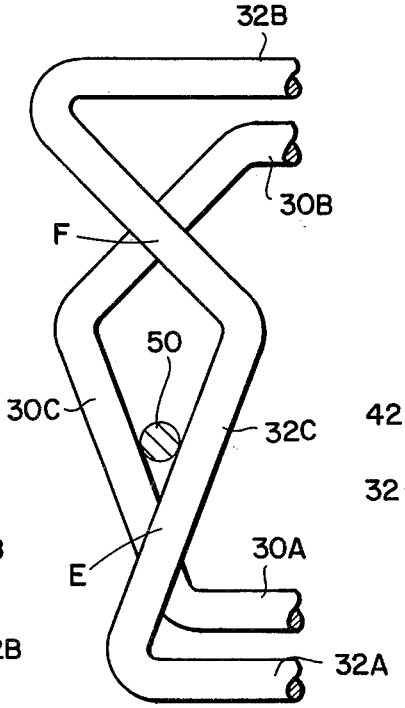
Fig. 7
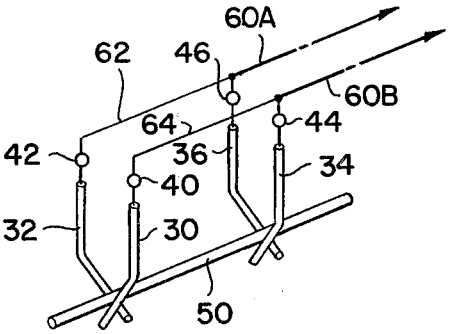

ELECTRICAL SWITCH

This invention relates to electrical switches, and more particularly to vibration sensitive switches suitable for use in intrusion detection systems and the like.

Vibration sensors of many types have been proposed for use in a diversity of applications, including security equipment and safety equipment. Such vibration sensors operate in response to the movement of the switch under the influence of an accelerating force, for example vibration or impact.

In security and burglar alarm systems, the vibration sensor should be compact so that it may be mounted unobtrusively, and reliable in operation as it may be inactive for several months or more before it is actuated by an intruder. Also, in an intrusion detection system, the vibration sensor must respond to an intruder but not to naturally occuring phenomena. The appropriate sensitivity of the sensor may differ for particular applications, depending on the environment in which it is used and/or the structure on which it is mounted. For example a sensor of relatively low sensitivity would be used on a structure that readily transmits vibration, such as a window frame or a thin wall; while it would be desirable to use a sensor of greater sensitivity on a structure that does not transmit vibrations as readily.

In accordance with the invention there is provided a vibration sensor that includes a base that supports two pairs of spaced juxtaposed electrical contact members, with each pair of contact members defining a support region. A vibration sensing crossbar element has two electrical conductive bridging portions, with each bridging portion mounted in a corresponding support region for completing an electrical circuit between the two juxtaposed contact members while being permitted to move away from those contact members when the sensor is subjected to an acceleration force. An electric terminal is connected to each contact for connection to remote circuitry.

In preferred embodiments, each contact member is a wire that is connected to a terminal and the two wires of each pair are disposed in side-by-side spaced relation and crossing at an angle to one another. The vibration sensing member includes an elongated rod member with each end supported in the support nest provided by the pair of contact wires. Each contact point is a concentrated area that provides relatively high contact pressure. The crossing angle of the two wires in each support region may be selected as the function of the desired sensitivity with smaller crossing angles providing greater damping or crossbar retention action. In a particular embodiment, each pair of wires provides two (upper and lower) support region areas, with the crossing angle of the wires in one support region being at least fifteen degrees greater than the crossing angle of the wires in the other support region so that different switch sensitivities may be selected, depending on the mounted position of the switch.

The sensitivity of the switch may also be varied as a function of the interconnection of the contact members, in series, in parallel, or in series-parallel combination.

In a particular embodiment, both the contact wires and the crossbar wire are noble metal plated and of about one millimeter diameter. The body member has a slot in the face from which the contact wires project, and the crossbar wire carries a metal disc with a peripheral portion of the disc disposed in the slot so that lateral movement of the crossbar wire is limited and its vertical movement is guided. The weight of this guide disc may be selected as a further sensitivity control. Where environmental disturbances are abnormally high, supplemental restraint, for example of the magnetic type, may be used. The array of contact wires and the crossbar wire is contained within a completely sealed plastic housing as protection against adverse environmental conditions, and may be used with electronic analyzers to provide a reliable and versatile intruder protection system.

Other features and advantages of the invention will be seen as the following description of a particular embodiment progresses, in conjunction with the drawings, in which:

FIG. 1 is a perspective view of a vibration sensor in accordance with the invention with the cover spaced from the body;

FIG. 2 is a perspective view of the body and vibration sensing components of the sensor shown in FIG. 1;

FIG. 3 is a sectional view taken along the line 3—3 of FIG. 1;

FIG. 4 is a sectional view of the switch body and wire array taken along the line 4—4 of FIG. 3;

FIG. 5 is a diagram showing the support wires and bridging crossbar array in a mode of high sensitivity;

FIG. 6 is a diagram similar to FIG. 5 showing a mode of greater damping; and FIG. 7 is a diagram indicating one of the possible circuit interconnections.

DESCRIPTION OF PARTICULAR EMBODIMENT

The vibration sensor shown in FIG. 1 includes a body member 10 of electrically insulating material, a front end cap 12 and a rear end cap 14. The switch unit has a diameter of about two centimeters and a length of about $2\frac{1}{2}$ centimeters. Body member 10 has a cylindrical surface 16 which receives cap 12 for seating against flange 18, and a similar cylindrical surface 20 which receives end cap 14. Key 22 orients end cap 12 relative to body 10 so that the indicator letters "H" and "L" on the face 24 of cap 12 are properly aligned with body 10. Formed in the front wall 26 of body 10 is a vertically extending channel 28 that has parallel side wall surfaces.

Four gold-plated wires 30, 32, 34, 36, each about $\frac{3}{4}$ millimeter in diameter, are embedded in body 10. Each wire is connected to a corresponding terminal 40, 42, 44, 46 on the rear surface 48 of body 10 and extends through the body to a fixed loop portion that projects forward from front surface 26. Each wire includes parallel upper and lower support segments A and B that extend from the front wall 26 of body 10, and contact segments C and D that extend between those support segments. Wires 30 and 36 have loops of similar shape with each contact segment C being disposed at an angle of about 112 degrees to its support segment A, and each contact segment D disposed at an angle of about 135 degrees to its support segment B. Wires 32 and 34 have loops of similar shape with each contact segment C disposed at an angle of about 67 degrees to its support segment A and each contact segment B disposed at an angle of about 45 degrees to its support segment B, as indicated in FIG. 5. The pair of wires 30, 32 and the pair of wires 34, 36 thus each define a retention area defined by their crossing contact segments C and D, with segments C being at a crossing angle of about 45 degrees to one another at intersection E, and segments B being at a crossing angle of about 90 degrees to one another at intersection F as indicated in FIG. 5.

The vibration sensing assembly also includes gold plated crossbar wire 50 (about ¾ millimeter in diameter) on which is secured cylindrical brass disc 52 that has a diameter of about one centimeter and a thickness of about 0.6 millimeter. One end of crossbar 50 is disposed in the retention region defined by wires 30 and 32 and the other end of crossbar 50 is disposed in the retention region defined by wires 34 and 36. At rest, cross bar 50 completes a first circuit between wires 30 and 32, and a second circuit between wires 34 and 36, and also interconnects those two circuits. A peripheral portion of disc 52 is disposed in slot 28, and functions both to limit transverse movement of rod 50 and to guide the vertical movement of that rod under the influence of accelerating forces.

In practical use of the vibration sensor, for example, as an intruder alarm, the sensor is mounted at a location that would be subjected to vibration or impact by any person seeking to gain unauthorized access. The sensor may be mounted in upright ("low damping") position as indicated in FIG. 5, or in inverted ("greater damping") position as indicated in FIG. 6. In the low damping (high sensitivity) position, wire 50 is supported at the 90 degree crossing of contact segments D as indicated in FIG. 5. When the switch unit is inverted to the position shown in FIG. 6, cross bar wire 50 rests on contact segments C which cross at an angle of 45 degrees and provide enhanced restraining force on the crossbar wire 50. Output conductors 60 are connected to terminals 40, 42, 44, and 46 and to remote sensor monitoring equipment (not shown).

Whenever the switch is subjected to vibration or impact sufficient to lift crossbar 50 from one or both of its support regions, one or more circuit contacts will be opened. Depending on the terminal interconnection, that contact opening(s) may interrupt the electrical current flow circuit between conductors 60A and 60B. For example in the series-parallel circuit connection shown in FIG. 7 a first shortening link 62 connects wires 32 and 36 and a second shortening link 64 connects wires 30 and 34. Terminals 44 and 46 are connected to output leads 60A and 60B. With this circuit connection the acceleration force to which the vibration sensor is subjected must be sufficient to break a contact at each end of crossbar 50 to interrupt the circuit between leads 60A and 60B. The sensitivity of the switch may be changed in a variety of different ways, including changing the circuit interconnections, and changing the switch positions. Other sensitivities may be obtained by changing size and/or material of guide disc 52, and by changing the shape of the wire retention areas.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. A vibration sensor comprising a base, first and second support structures on said base, each said support structure including a pair of spaced juxtaposed electrical contact members, each said pair of contact members having electrically spaced contact surfaces disposed at an angle to one another that define a support region, an elongated crossbar element having two spaced apart electrically conductive portions, each said electrically conductive portion being supported on the contact surfaces in a corresponding one of said support regions for completing an electric circuit between that corresponding pair of contact members and for movement away from said contact members under the influence of acceleration forces to which said base is subjected to open said electric circuit, and terminal means connected to each said contact member for connection to remote circuitry.

2. The sensor of claim 1 wherein said crossbar element and each said contact member is a wire of circular cross section.

3. A vibration sensor comprising a base, first and second support structures on said base, each said support structure including a pair of wires disposed in spaced, side by side relation and crossing at an angle to one another to provide a support nest, a crossbar element having two spaced apart electrically conductive portions, each said electrically conductive portion being supported on the wires in a corresponding one of said support nests for completing an electric circuit between that corresponding pair of wires and for movement away from said wires under the influence of acceleration forces to which said base is subjected, and terminal means on said base connected to each said wire for connection to remote circuitry.

4. The sensor of claim 3 wherein each cooperating pair of wires cross at two spaced (upper and lower) intersection points and define a retention aperture in which the cooperating electrically conductive portion of said cross bar element is disposed.

5. A vibration sensor comprising a base of electrically insulating material an array of wires supported on said base, said array of wires defining two spaced retention areas, each said retention area being defined by a pair of spaced juxtaposed wires that have contact portions disposed at an angle to one another, an elongated crossbar element freely supported in said retention areas for movement relative to said wire array under the influence of acceleration forces, said crossbar element having two spaced apart electrically conductive portions, each said electrically conductive portion being disposed within a corresponding one of said retention areas, each said conductive portion completing an electric circuit between a corresponding pair of wires that define a retention area, and terminal means connected to each said wire for connection to remote circuitry.

6. The sensor of either claim 1 or 5 wherein said crossbar element includes an electrically conductive rod.

7. The sensor of either claim 1 or 5 and further including means for limiting lateral movement and guiding vertical movement of said crossbar element under acceleration forces.

8. The sensor of either claim 1 or 5 and further including a counterweight secured to said crossbar element between the ends thereof.

9. The sensor of claim 8 wherein said counterweight is a disc and said base includes a channel in which a peripheral portion of said disc is received.

10. The sensor of either claim 3 or 9 wherein each said pair of wires cross at two spaced intersections, the crossing angle of one intersection being at least fifteen degrees greater than the crossing angle of the other intersection.

11. A vibration sensor comprising a base of electrically insulating material, an array of wires supported on said base, said array of wires defining two spaced retention areas, each said retention area being defined by a pair of wires which cross at two spaced intersections, the crossing angle of one intersection being at least fifteen degrees greater than the crossing angle of the other intersection, a crossbar element freely supported in said retention areas for movement relative to said wire array under the influence of acceleration forces, said crossbar element having two spaced apart electrically conductive portions, each said electrically conductive portion being disposed within a corresponding one of said retention areas, each said conductive portion completing an electric circuit between a corresponding pair of wires that define a retention area, and terminal means connected to each said wire for connection to remote circuitry.

12. The sensor of any one of claims 1, 3, 5, 2 or 11 wherein said crossbar element has a guide member secured thereto between the ends thereof, and said base includes a guide channel in which a portion of said guide member is received.

13. The sensor of claim 12 wherein said cross bar element is a wire of circular cross section in the order of about one millimeter in diameter and has a noble metal surface.

* * * * *